US006464007B1

(12) United States Patent
Jones

(10) Patent No.: US 6,464,007 B1
(45) **Date of Patent: *Oct. 15, 2002**

(54) METHOD AND WELL TOOL FOR GRAVEL PACKING A LONG WELL INTERVAL USING LOW VISCOSITY FLUIDS

(75) Inventor: Lloyd G. Jones, Granbury, TX (US)

(73) Assignee: ExxonMobil Oil Corporation, Irving, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/642,563

(22) Filed: Aug. 22, 2000

(51) Int. Cl.[7] ..... E21B 43/04
(52) U.S. Cl. ..... 166/279; 166/235
(58) Field of Search ..... 166/268, 271, 166/278, 280, 284, 285, 306, 308, 192, 220, 235

(56) References Cited

U.S. PATENT DOCUMENTS

| | | | | |
|---|---|---|---|---|
| 4,657,079 | A | 4/1987 | Nagaoka | 166/231 |
| 4,818,403 | A | 4/1989 | Nagaoka | 210/448 |
| 4,945,991 | A | 8/1990 | Jones | |
| 5,069,279 | A | 12/1991 | Nagaoka | 166/234 |
| 5,082,052 | A | 1/1992 | Jones et al. | |
| 5,113,935 | A | 5/1992 | Jones et al. | |
| 5,161,613 | A | 11/1992 | Jones | 166/242 |
| 5,161,618 | A | 11/1992 | Jones et al. | 166/308 |
| 5,246,158 | A | 9/1993 | Nagaoka et al. | 228/175 |
| 5,307,984 | A | 5/1994 | Nagaoka et al. | 228/189 |
| 5,311,942 | A | 5/1994 | Nagaoka | 166/232 |
| 5,333,688 | A | 8/1994 | Jones et al. | 166/278 |
| 5,333,689 | A | 8/1994 | Jones et al. | 166/278 |
| 5,390,966 | A | 2/1995 | Cox et al. | 284/137.1 |
| 5,417,284 | A | 5/1995 | Jones | 166/280 |
| 5,419,394 | A | 5/1995 | Jones | 166/51 |
| 5,435,391 | A | 7/1995 | Jones | 166/308 |
| 5,476,143 | A | 12/1995 | Sparlin et al. | 166/233 |
| 5,515,915 | A | 5/1996 | Jones et al. | |
| 5,560,427 | A | 10/1996 | Jones | 166/280 |
| 5,588,487 | A | 12/1996 | Bryant | 166/51 |
| 5,690,175 | A | 11/1997 | Jones | 166/278 |
| 5,787,980 | A | 8/1998 | Sparlin et al. | 166/231 |
| 5,842,516 | A | 12/1998 | Jones | 166/56 |
| 5,848,645 | A | 12/1998 | Jones | 166/280 |

(List continued on next page.)

FOREIGN PATENT DOCUMENTS

| | | | |
|---|---|---|---|
| CA | 2325761 | 11/2000 | |
| EP | 1087099 A | 3/2001 | |
| EP | 1132571 A | 9/2001 | |
| WO | WO 00/61913 | 10/2000 | E21B/43/04 |
| WO | WO 01/14691 | 3/2001 | E21B/43/08 |

OTHER PUBLICATIONS

Jones, Lloyd G. "Spectacular Wells Result From Alternate Path Technology", Petroleum Engineer International, Hart Publications, US, vol. 72, No. 5, May 1999, pp. 31–33, 36–38.

*Primary Examiner*—David Bagnell
*Assistant Examiner*—Jennifer H Gay

(57) ABSTRACT

A method and well tool for using a low-viscosity slurry to gravel pack a completion interval. The well tool is comprised of a screen and at least one alternate flowpath which is initially closed to flow by a valve means. Once a sand bridge is formed in the completion interval, the pressure of the pumped slurry increases which, in turn, opens the valve means to allow flow through the alternate flowpath. Preferably, a plurality of flowpaths of different lengths are provided, all of which include valve means which are adapted to open at different pressures.

9 Claims, 1 Drawing Sheet

U.S. PATENT DOCUMENTS

| | | | | |
|---|---|---|---|---|
| 5,868,200 | A | 2/1999 | Bryant et al. | 166/51 |
| 5,890,533 | A | 4/1999 | Jones | 166/51 |
| 5,934,376 | A | 8/1999 | Nguyen et al. | 166/278 |
| 6,003,600 | A | 12/1999 | Nguyen et al. | 166/281 |
| 6,059,032 | A | 5/2000 | Jones | |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,298,916 | B1 * | 10/2001 | Tibbles et al. | 166/278 |
| 6,302,207 | B1 | 10/2001 | Nguyen et al. | 166/276 |

* cited by examiner

METHOD AND WELL TOOL FOR GRAVEL PACKING A LONG WELL INTERVAL USING LOW VISCOSITY FLUIDS

FIELD OF THE INVENTION

The present invention relates to gravel packing a wellbore and in one of its aspects relates to a method and well tool for gravel packing a long interval within a wellbore using a low viscosity fluid wherein a good distribution of gravel is achieved across the entire interval.

BACKGROUND

In producing hydrocarbons or the like from loosely consolidated and/or fractured subterranean formations, it is not uncommon to produce large volumes of particulate material (e.g. sand) along with the formation fluids. As is well known, these particulates routinely cause a variety of problems and must be controlled in order for production to remain economical. Probably the most popular technique used for controlling the production of sand from a producing formation is one which is commonly known as "gravel packing."

In a typical gravel pack completion, a screen or the like is lowered into the wellbore and positioned adjacent the interval of the well which is to be completed. Particulate material, collectively referred to as "gravel," is then pumped as a slurry down a workstring and exits above the screen through a "cross-over" or the like into the well annulus around the screen. The liquid in the slurry is lost into the formation and/or through the openings in the screen thereby resulting in the gravel being deposited or "screened out" in the annulus around the screen. The gravel is sized so that it forms a permeable mass or "pack" between the screen and the producing formation which, in turn, allows flow of the produced fluids therethrough and into the screen while substantially blocking the flow of any particulate material therethrough.

A major problem associated with gravel packing, especially where thick or inclined production intervals are to be completed, is insuring good distribution of gravel throughout the completion interval. That is, if gravel is not distributed over the entire completion interval, the gravel pack will not be uniform and will have voids therein which reduces its efficiency. Poor distribution of gravel across an interval is often caused by the premature loss of liquid from the gravel slurry into the formation as the gravel is being placed. This loss of fluid can cause "sand bridges" to form in the annulus before all of the gravel has been distributed within the annulus. These bridges block further flow of the slurry through the well annulus thereby preventing the placement of sufficient gravel (a) below the bridge for top-to-bottom packing operations or (b) above the bridge, for bottom-to-top packing operations.

Recently, well tools have been developed which provide a good distribution of gravel throughout the desired interval even where sand bridges form in the annulus before all the gravel has been deposited. These tools (e.g. well screens) include a plurality of "alternate flowpaths" (e.g. shunts or perforated conduits) which extend along the screen and receive gravel slurry as it enters the wellbore annulus. If a sand bridge forms before all of the gravel is placed, the slurry will by-pass the sand bridge and will flow out through the shunt conduits to different levels within the annulus to thereby complete the gravel packing of the annulus above and/or below the bridge. For complete details of such well tools; see U.S. Pat. Nos. 4,945,991; 5,082,052; 5,113,935; 5,515,915; and 6,059,032; all of which are incorporated herein by reference.

Well tools having alternate flowpaths such as those described above have proved successful in completing relatively thick wellbore intervals (i.e. 100 feet or more) in a single operation. In such operations, the carrier fluid in the gravel slurry is typically comprised of a highly-viscous gel. However, it is often advantageous to use low-viscosity fluids (e.g. water, thin gels, or the like) as the carrier fluid for the gravel slurry since such slurries are less expensive, do less damage to the producing formation, give up the gravel more readily than do those slurries formed with more viscous gels, and etc.

Unfortunately, however, the use of low-viscosity slurries may present some problems when used in conjunction with "alternate path" screens for gravel-packing long intervals of a wellbore. This is primarily due to the low-viscosity, carrier fluid being prematurely "lost" through the spaced outlets (i.e. perforations) in the shunt tubes thereby causing the shunt tube(s), themselves, to "sand-out" at one or more of the perforations therein, thereby blocking further flow of slurry through the blocked shunt tube. When this happens, there can be no assurance that slurry will be delivered to all levels within the interval being gravel packed.

SUMMARY OF THE INVENTION

The present invention provides a method and a well tool for gravel packing a completion interval within a wellbore which provides for a good distribution of gravel across the interval while using a gravel slurry having a low-viscosity carrier fluid, e.g. water. Basically, the gravel packing tool of the present invention is comprised of a well screen which has at least one alternate flowpath which extends along the screen. The alternate flowpath is initially closed to flow by a valve means which is adapted to open at a predetermined pressure. When a sand bridge forms in the annulus adjacent the completion interval, the pressure on the pumped slurry increases to open the valve means to thereby allow the slurry to flow through the alternate flowpath to complete the gravel packing of the completion interval.

More specifically, the gravel pack tool is comprised of a screen which is positioned adjacent the completion interval by a workstring. Preferably, a plurality of alternate flowpaths (i.e. unperforated or blank shunt tubes) of different lengths are positioned along the screen. Each of the tubes is open at its upper end to form an inlet and is open at its bottom end to form an outlet. A valve means, e.g. rupture disk, check valve, etc., is positioned at the inlet of each tube to initially block flow therethrough. Each of the valve means is adapted to open at a different pressure so that the tubes will be opened sequentially as successive sand bridges are formed in the annulus which, in turn, cause the pressure on the pumped slurry to increase in the annulus.

By providing shunt tubes of different lengths and having only one outlet (i.e. open lower end), blank shunt tubes (i.e. unperforated along their lengths) can be used to deliver slurry to different levels within the completion interval. By being able to use blank shunt tubes, the risk of a particular tube "sanding-out" at a spaced outlet along its length is alleviated. Further, by initially closing each tube to flow, flow of the low-viscosity fluid through a particular shunt tube will only occur after a sand bridge has been formed in the annulus and the pressure of the slurry in the annulus has substantially increased. This results in a higher flowrate through the now-open shunt tube which is highly beneficial in keeping the gravel suspending in the low-viscosity carrier fluid as the slurry flows through the tube.

BRIEF DESCRIPTION OF THE DRAWINGS

The actual construction, operation, and apparent advantages of the present invention will be better understood by referring to the drawings which are not necessarily to scale and in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

Figure 1:
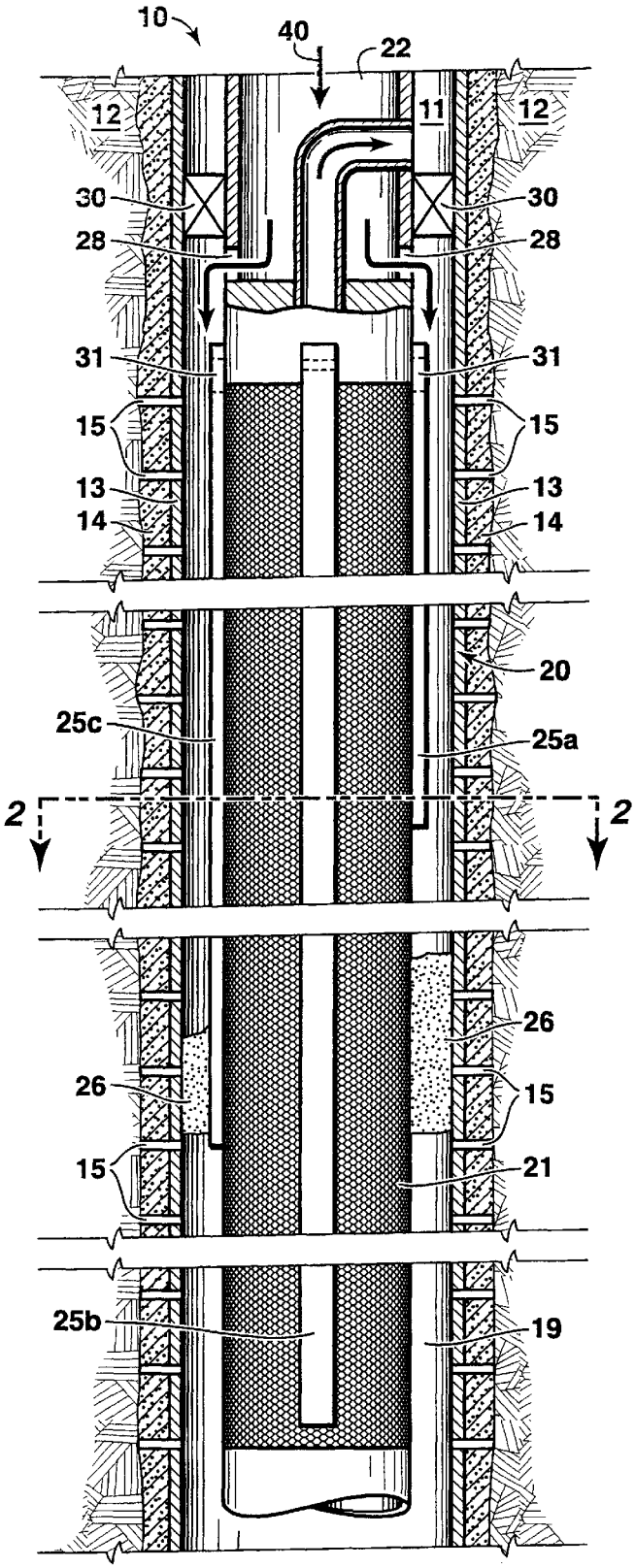
FIG. 1 is a sectional view of the apparatus of the present invention in an operable position within a wellbore and adjacent to an interval which is to gravel packed in accordance with the present invention.

Referring more particularly to the drawings, FIG. 1 illustrates a lower section of a producing/injection well 10 having a wellbore 11 which extends from the surface (not shown) through a production/injection formation 12. As shown, wellbore 11 is cased with casing 13 and cement 14 which, in turn, have perforations 15 therethrough to establish fluid communication between formation 12 and the inside of casing 13. While well 10 is illustrated in FIG. 1 as one having a substantial vertical, cased wellbore, it should be recognized that the present invention can equally be used in open-hole and/or underreamed completions as well as in inclined and/or horizontal wellbores.

Gravel pack tool 20 of the present invention is positioned within wellbore 11 adjacent a completion interval of formation 12 and forms annulus 19 with the casing 13. Tool 20 is comprised of a screen 21 having a "cross-over" sub 22 connected to its upper end which, in turn, is suspended from the surface on a tubing or work string (not shown). The term "screen" as used throughout the present specification and claims is meant to refer to and cover any and all types of permeable structures commonly used by the industry in gravel pack operations which permit flow of fluids therethrough while blocking the flow of particulates (e.g. commercially-available screens, slotted or perforated liners or pipes, screened pipes, wire-wrapped base pipes, prepacked screens and/or liners, or combinations thereof). Screen 21 can be of one continuous length or it may be comprised of sections (e.g. 30-foot sections) which are connected together by subs and/or blanks.

Figure 2:
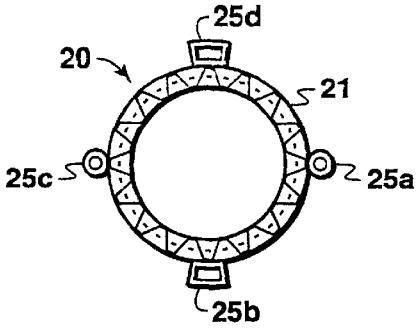
FIG. 2 is a cross-sectional view taken at line 2—2 of FIG. 1.

Alternate paths means 25 is provided along the length of tool 20, and as shown in FIGS. 1 and 2, is comprised of a plurality of relatively small (i.e., 1 to 1½ inch diameter or smaller), blank conduits, i.e. unperforated shunt tubes 25*a–d* of varying lengths, which are radially-spaced around the tool 20 and which extend longitudinally along the length thereof. These shunt tubes may be round in cross-section (e.g. 25*a*, 25*c*) or take other cross-sectional shapes (e.g. substantially rectangular 25*b*, 25*d*, FIG. 2). Each shunt tube is open at its upper end to provide an inlet for receiving gravel slurry as will be explained below and is open at its lower end to provide an outlet therefrom. Further, shunt tubes 25*a–d* may be positioned on the exterior of screen 21, as shown, or they may be positioned within the screen as shown in U.S. Pat. No. 5,515,915, which is incorporated herein by reference.

By varying the lengths of the shunt tubes 25*a–d*, gravel slurry flowing through a respective shunt tube will be delivered to different levels within annulus 19 during the gravel pack operation. Where the gravel pack interval lies within a horizontal wellbore or the like, the term "level", as used herein, is intended to refer to relative lateral positions within the wellbore.

Tool 20, as described to this point, is similar in both construction and operation to prior art, alternate path screens of this type, see U.S. Pat. No. 5,113,935. In these type of tools, the shunt tubes are normally perforated along their lengths to provide spaced outlets through which the slurry is delivered to different levels within the gravel pack interval. These tools are typically used to distribute slurries which have relatively-high viscosity gels as the carrier fluid and have proven to be highly successful when so used.

However, problems may arise when using these prior art tools to distribute slurries formed with low-viscosity carrier fluids. As used herein, "low-viscosity" is meant to cover fluids which are commonly used for this purpose and which have a viscosity of 30 centipoises or less (e.g. water, low viscosity gels, etc.). Due to its low-viscosity, the carrier fluid may be rapidly lost at one or more of the spaced perforations in the shunt tubes of the prior art tools as the slurry flows through the tubes. This rapid loss of the low-viscosity carrier fluid from the slurry presents a real threat in that one or more of the tubes can quickly "sand-out" at those perforations where the fluid is being rapidly lost thereby blocking further flow of slurry through that tube. Since the well annulus may already be blocked by a sand bridge, the blocked shunt tube(s) will prevent further delivery of slurry to the different levels within the annulus thereby resulting in a poorly-packed completion interval.

Figure 3:
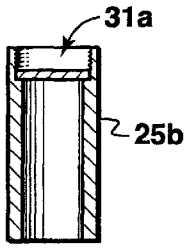
FIG. 3 is a partial sectional view of the upper end of a shunt tube of the apparatus of FIG. 1 illustrating one type of valve means used in the present invention.

Tool 20 of the present invention is capable of providing good distribution of gravel over a long and/or inclined and/or horizontal completion interval even when a low-viscosity carrier fluid is used to form the gravel slurry. To do this, flow is initially blocked through each of the shunt tubes 25*a–d* by a valve means 31 which is positioned at or near the top of each respective shunt tube. Valve means 31 may be any type of valve which blocks flow when in a closed position and which will open at a predetermined pressure. For example, valve 31 may be comprised of a disk 31*a* (FIG. 3) which is positioned within the inlet of shunt tube 25*b* and which will rupture at a predetermined pressure to open the shunt tube to flow.

Figure 4:
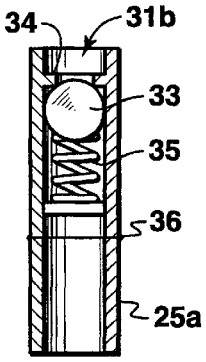
FIG. 4 is a partial sectional view of the upper end of another shunt tube of the apparatus of FIG. 1 illustrating another type of valve means used in the present invention.

Another example of a valve means 31 is check valve 31*b* which is positioned within the inlet of shunt tube 25*a* (FIG. 4). Valve 31*b* is comprised of a ball element 33 which is normally biased to a closed position on seat 34 by spring 35 which, in turn, is sized to control the pressure at which the valve will open. Valve means 31 are preferably made as separate components which, in turn, are then affixed to the tops of the respective shunt tubes by any appropriate means, e.g. welds 36 (FIG. 4), threads (not shown), etc.

Preferably, each valve means 31 will be set to open at a different pressure from the others. That is, valve means 31 on the shortest shunt tube (e.g. tube 25*a* in FIG. 1) will open at the lowest respective opening pressure, valve means 31 on the next shortest tube 25*c* will open at a higher opening pressure, and so on with valve means 31 on the longest tube 25*b* opening at the highest respective opening pressure; the reason for which will be explained below.

In carrying out the method of the present invention, gravel pack tool 20 is lowered into wellbore 11 and is positioned adjacent interval 12. Packer 30 is set as will be understood by those skilled in the art. All of the shunt tubes 25 will be closed to flow at their respective upper ends by respective valve means 31. A slurry (heavy arrows 40 in FIG. 1) comprised of a low-viscosity carrier fluid and "gravel" (e.g. particulates such as sand, etc.) is pumped down the workstring, through outlets 28 in cross-over 22, and into the upper end of annulus 19 which surrounds tool 20 throughout the completion interval 12. Again, as used herein, "low-viscosity" is meant to cover fluids which are commonly used as carrier fluids and which have a viscosity of 30 centipoises or less (e.g. water, low viscosity gels, etc.).

As slurry 40 flows through annulus 19, the carrier fluid from the slurry is "lost" through perforations 15 into the formation 12 and also through screen 21. As this happens, the gravel separates from the slurry and accumulates within annulus 19 to form the desired "gravel pack" around screen 21. However, if the carrier fluid is lost too rapidly from the slurry, a sand bridge(s) 26 will form within the annulus which blocks further flow of slurry therethrough. In the present invention, when this happens, pressure on the slurry being pumped into the top of annulus 19 will continue to increase until that pressure is reached which is required to open valve means 31 on the shortest tube 25*a*; i.e. disk 31*a* will rupture, check valve 31*b* will open, etc., depending on the type of valve means being used.

The low-viscosity slurry 40 can now flow down the shortest shunt tube 25*a* to fill that portion of annulus 19 which lies above the sand bridge 26 with gravel and which is in fluid communication with the outlet (i.e. lower end) of tube 25*a*. Since the shunt tubes have no perforations along their lengths, there is risk of the tubes sanding out, even through a low-viscosity carrier fluid is being used. This risk is further avoided by keeping the tubes closed to flow until a sand bridge 26 has formed in annulus 19 and the pressure of the slurry is increased to open valve means 31. This increase in pressure on the slurry will result in a much higher flow rate of the slurry through the respective shunt tubes than would have been the flow rate had the shunt tubes initially been open to flow. The substantially higher flow rate through the shunt tubes tends to keep the particulates suspended in the slurry while the slurry flows through the tubes.

Once the portion of the annulus 19 above sand bridge 26 is packed, the pressure of the pumped slurry 40 further increases as it enters the top of annulus 19 through cross-over 22. This further increase in pressure will now cause the second valve means 31 to open thereby permitting flow through the next shunt tube (e.g. 25*c*) to begin filling that portion of annulus 19 which lies below sand bridge 26. If a further sand bridge (not shown) is formed in the annulus at some location below sand bridge 26, then the respective shunts tubes (e.g. 25*c*, 25*d*) will sequentially open as the pressure of the slurry continues to increase as the packing of the different portions of the annulus is completed.

While four shunt tubes 25 have been shown, it should be recognized that a lesser or greater number of shunt tubes can be used without departing from the present invention, depending on a particular situation, e.g. length of the completion interval 12, etc.

What is claimed is:

1. A method for gravel packing a completion interval within a wellbore using a low-viscosity slurry; said method comprising:

positioning a gravel pack tool within said wellbore adjacent said completion interval, said gravel pack tool having a well screen and a plurality of alternate flowpaths of different lengths extending along said screen, each of said alternate flowpaths having an inlet and only one outlet, each said inlet initially being closed to flow;

flowing a slurry comprised of a low-viscosity carrier fluid and gravel down into the annulus which is formed between said gravel pack tool and said wellbore to deposit said gravel around said screen;

continuing the flow of said slurry until a sand bridge forms in said annulus;

opening each said inlet of said plurality of alternate flowpaths in response to respective different pressures after said sand bridge has been formed to allow the flow of said slurry into respective said alternate flowpaths and out of said outlets of said alternate flowpaths to complete said gravel packing of said completion interval.

2. The method of claim 1 wherein said carrier fluid is fluid having a viscosity of about 30 centipoises or less.

3. The method of claim 2 wherein said carrier fluid is water.

4. The method of claim 2 wherein said carrier fluid is a low-viscosity gel.

5. The method of claim 1 wherein each of said plurality of alternate flowpaths is initially closed by a valve means mounted at said inlet of each respective said alternate flowpath wherein each of said valve means is adapted to open at a respective different pressure.

6. A well tool for gravel packing a completion interval within a wellbore using a low-viscosity slurry, said well tool comprising:

a well screen adapted to be connected to the lower end of a work string;

a plurality of blank shunt tubes extending along said screen; each of said shunt tubes having an inlet and only one outlet, each of said shunt tubes being of a different length; and a valve means mounted at said inlet of each of said blank shunt tubes to initially block flow therethrough, each of said valve means being adapted to open at a different predetermined pressure to thereby sequentially open each of said blank shunt tubes to flow as pressure increases in said completion interval whereby said low-viscosity slurry will be delivered through said blank shunt tubes to different levels within said completion interval as each of said valve means opens at its respective pressure.

7. The well tool of claim 6 wherein each of said shunt tubes is open at its upper end to form said inlet and is open at its lower end to form said only one outlet.

8. The well tool of claim 7 wherein said valve means comprises:

a disk which is adapted to rupture at a predetermined pressure to open a respective shunt tube to flow.

9. The well tool of claim 7 wherein said valve means comprises:

a check valve adapted to open at a predetermined pressure to thereby open a respective shunt tube to flow.

* * * * *